US007086890B2

(12) United States Patent
Takeuchi

(10) Patent No.: US 7,086,890 B2
(45) Date of Patent: Aug. 8, 2006

(54) ARRANGEMENT OF PRESSURE CONTACT TERMINALS FOR ELECTRICAL JUNCTION BOX

(75) Inventor: Kunihiko Takeuchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/912,057

(22) Filed: Aug. 6, 2004

(65) Prior Publication Data

US 2005/0059274 A1 Mar. 17, 2005

(30) Foreign Application Priority Data

Sep. 17, 2003 (JP) ..... 2003-324448

(51) Int. Cl.
*H01R 4/24* (2006.01)
*H01R 4/26* (2006.01)
*H01R 11/20* (2006.01)

(52) U.S. Cl. ..... 439/405

(58) Field of Classification Search ..... 439/405
See application file for complete search history.

(56) References Cited

U.S. PATENT DOCUMENTS 4,902,243 A * 2/1990 Davis ..... 439/405
5,041,009 A 8/1991 McCleerey
6,171,134 B1 * 1/2001 Lai ..... 439/405
6,811,429 B1 * 11/2004 Recktenwald et al. ..... 439/405

FOREIGN PATENT DOCUMENTS

EP 0 381 380 A 8/1990

* cited by examiner

*Primary Examiner*—Hae Moon Hyeon
(74) *Attorney, Agent, or Firm*—Armstrong, Kratz, Quintos, Hanson & Brooks, LLP

(57) ABSTRACT

In one arrangement of press contact terminals, each press contact terminal (1) includes an electric contact part (2), a bent part (4), and a press contact part (3) for being connected with an electric wire. The electric contact parts (2) are arranged in line, the bent parts (4) are bent alternately forward and backward in perpendicular to the line for arranging the press contact parts (1) alternately in different directions. Each press contact terminal (1) has an identical shape. In another arrangement, press contact terminals (17), (18) include shorter bent parts (19) and longer bent parts (18) respectively. The electric contact parts (26) are arranged in line. The bent parts (19), (20) are bent in one direction perpendicular to the line, and alternately arranged. In the other arrangement, neighboring press contact parts (2) of the press contact terminals (1) overlap each other in a direction perpendicular to a line in which the press contact terminals (1) are arranged.

10 Claims, 4 Drawing Sheets

ARRANGEMENT OF PRESSURE CONTACT TERMINALS FOR ELECTRICAL JUNCTION BOX

The priority application Number Japanese Patent Application No. 2003-324448 upon which this patent application is based is hereby incorporated by reference.

1. Field of the Invention

This invention relates to an arrangement of press contact terminals for preventing mutual interference between wide electric wire contact parts thereof when closely arranging them.

2. Description of the Related Art

FIGS. 8 to 10 show a conventional arrangement of press contact terminals, which the applicant of this application formerly employed.

A press contact terminal 41 is formed by punching and bending a conductive metallic board. As shown in FIG. 9, the press contact terminal 41 includes a press contact part 42 at its lower part, a pin-type electric contact part 43 at its upper part, and a step-shaped bent part 44 at its middle part.

The press contact part 42 is wider than the electric contact part 43. As shown in FIG. 9, the press contact part 42 includes a pair of press contact pieces 45 arranged in its transverse direction, and a slot 46 arranged between the pair of press contact pieces 45 for press-fitting an electric wire and splitting a sheath of the electric wire. The press contact part 42 and the electric contact part 43 are integrated via the bent part 44, having a substantially crank shape.

As shown in FIG. 8, as terminals of a connector, press contact terminals 41 are arranged side by side on a substrate 48 made of insulating synthetic resin in an electrical junction box 47. For example, a connector housing made of synthetic resin receives the pin-type electric contact part 43 of each press contact terminal 41, then is engaged with a mating connector (not shown), so that each electric contact part 43 is electrically connected to a female terminal of the mating connector.

For another example, each electric contact part 43 is inserted into the connector housing made of synthetic resin, and connected to a female joint terminal (not shown) in the connector housing. Thus, predetermined press contact terminals 41 are connected to each other via the joint terminal. As described above, a configuration of the connector is modified properly according to such as a specification of a circuit.

Each press contact part 42 is inserted or press-fitted into a hole 49 of the substrate 48. A base of the press contact part 42 is fixed to the substrate 48. The bent part 44 is disposed on a bearing surface at an upper edge of the hole 49, for example, an upper surface of a horizontal groove 50 in right side of FIG. 8. The electric contact part 43 stands vertically from the substrate 48.

A coated insulated electric wire (not shown) is press contacted with the press contact part 42 under the substrate 48. Namely, while the insulating coat of the electric wire is split by blades at inner ends of the pair of press contact pieces 45, a conductive core wire of the electric wire is press-fitted into the slot 46. Electric wires are arranged at a bottom surface side of the substrate 48.

In addition, the electrical junction box 47 is sometimes mounted on a vehicle upside down in FIG. 8, namely, the electric contact part 43 is arranged downward from the electrical junction box 47. Normally, when the electric wire is press-fitted into the press contact part 42, the press contact part 42 is arranged upward, and the electric wire is press-fitted from above the press contact part 42 with a blade tool (not shown).

However, there is a problem among the conventional arrangement of press contact terminals as described above. Recently, there is a necessity to reduce a pitch of the electric contact parts 43 corresponding to miniaturization of connectors and electrical junction boxes. However, such a miniaturization may cause the press contact parts 42, which are wider than the electric contact parts 43, to interfere with each other. Resultingly, insulation performance of the electrical junction box becomes worse.

An object of this invention is to provide an arrangement of press contact terminals for preventing mutual interference between wider electric wire contact parts thereof when closely arranging them. This arrangement secures their electric connections with electric wires, and allows a space between the press contact terminals to be reduced. Another object of this invention is to provide a connector and an electrical junction box having said arrangement so as to achieve further miniaturization of the connector and the electrical junction box.

SUMMARY OF THE INVENTION

In order to attain the object, according to this invention, there is provided an arrangement of press contact terminals, including press contact terminals, each of which having an electric contact part, a bent part, and a press contact part for being connected with an electric wire, whereby the electric contact parts are arranged in line, the bent parts are bent alternately forward and backward in a direction perpendicular to the line of arrangement of the electric contact parts for arranging the press contact parts alternately in different directions.

According to this arrangement, since spaces between neighboring press contact parts are increased, interference among press contact parts is prevented. Further, electric wires are easily and reliably press-contacted with the press contact parts respectively. The male press contact parts can be arranged at a narrower pitch. Electric connection reliability of the electric contact parts can be improved.

According to this invention, preferably, there is provided the arrangement of press contact terminals, wherein each of said press contact terminals has an identical shape.

According to this arrangement, the number of types of press contact terminals is reduced. Therefore, a production cost of a product according to this arrangement can be reduced.

In order to attain the object, according to this invention, there is provided another arrangement of press contact terminals, each of which having an electric contact part, a bent part, and a press contact part for press-contacting an electric wire, whereby at least two types of the press contact terminals having two different lengths in the bent parts are employed, the electric contact parts of the press contact terminals are arranged in line, the bent parts are bent in one direction and perpendicular to the line of arrangement of the electric contact parts, and the press contact terminals having longer bent parts and those having shorter bent parts are alternately arranged.

According to this arrangement, since spaces between neighboring press contact parts are increased, interference among the press contact parts is prevented. Further, since the press contact parts are arranged in one direction from the electric contact parts respectively, electric wires are easily and reliably press-contacted with the press contact parts respectively. Thus, electric connection reliability of the electric contact parts can be improved. The male press contact parts can be arranged at a narrower pitch. Further, since each bent part is bent in the same direction and each press contact part is displaced from the electric contact part in the same direction, the electric contact parts of the press contact terminals arranged in two lines are arranged back to back. Since the press contact parts are arranged in one direction from the electric contact parts respectively, the press contact terminals can be assembled effectively.

According to this invention, preferably, there is provided the arrangement of press contact terminals, wherein neighboring press contact parts of said press contact terminals overlap each other in a direction perpendicular to a line of arrangement of the press contact terminals.

According to this arrangement, each press contact part for press-contacting with an electric wire, which is wider than each of electric contact parts and bent parts, is placed at a dead space between neighboring press contact terminals. Thereby, an arrangement of the press contact terminals is further miniaturized in an arranging direction of the press contact terminals, namely, in a width direction of each press contact terminal.

According to this invention, there is provided a connector including any one of the arrangements of the press contact terminals described above.

According to this combination, since a pitch of the electric contact parts is reduced, this connector, which receives the electric contact parts of the press contact terminals, can be miniaturized. When a connector has the arrangement that the bent parts having different lengths from neighboring bent parts are arranged in a line and bent in one direction as described above, two connectors can be arranged in parallel adjacent to each other in a form that electric contact parts in two connector are arranged back to back. In addition, one connector can receive two lines of the press contact terminals in a form that the electric contact parts arranged in two lines are arranged back to back. Thus, a multiway connector can be made. Such a connector includes a plurality of press contact terminals and a connector housing for receiving those press contact terminals. Thereby, these connectors can cope with diversified connection specifications or increasing number of connection circuits.

According to this invention, there is provided an electrical junction box including said connector described above.

According to this combination, the electrical junction box can be miniaturized by using the miniaturized connector. The electrical junction box includes a substrate (circuit board) on which press contact terminals are mounted, electric wires press-contacted with press contact parts respectively, and a cover to cover those components.

DESCRIPTION OF THE PREFERRED EMBODIMENT

One embodiment of an arrangement of press contact terminals according to this invention will now be described with reference to Figures.

Figure 1:
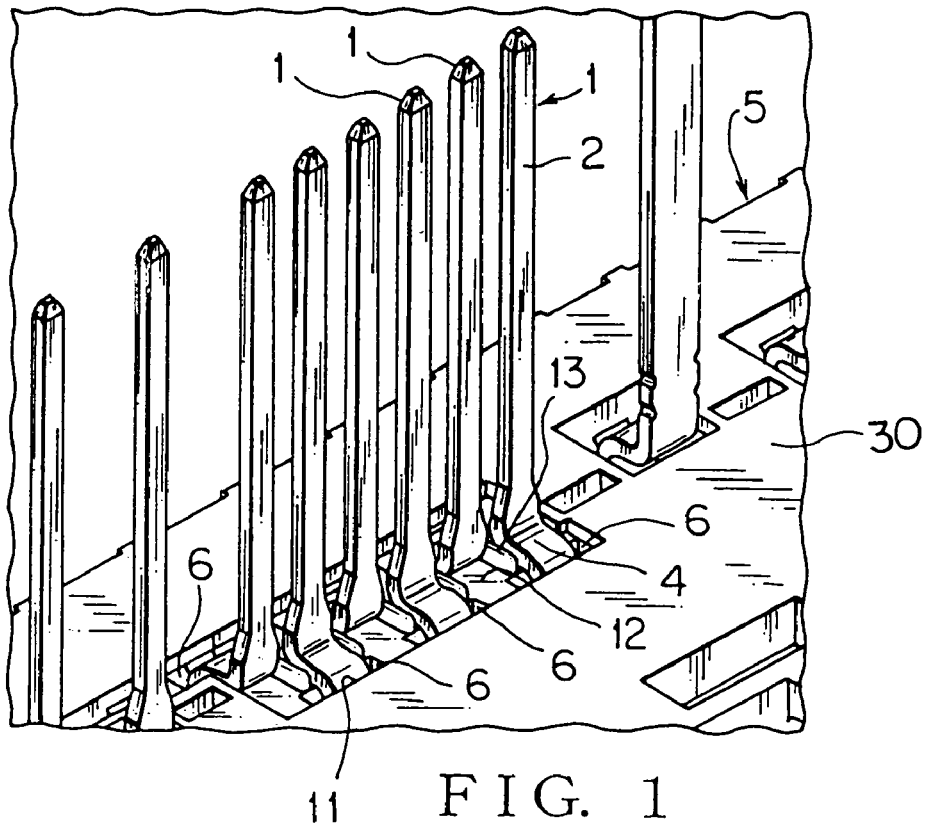
FIG. 1 is a perspective view showing a first embodiment of an arrangement of press contact terminals according to this invention.
Figure 2:
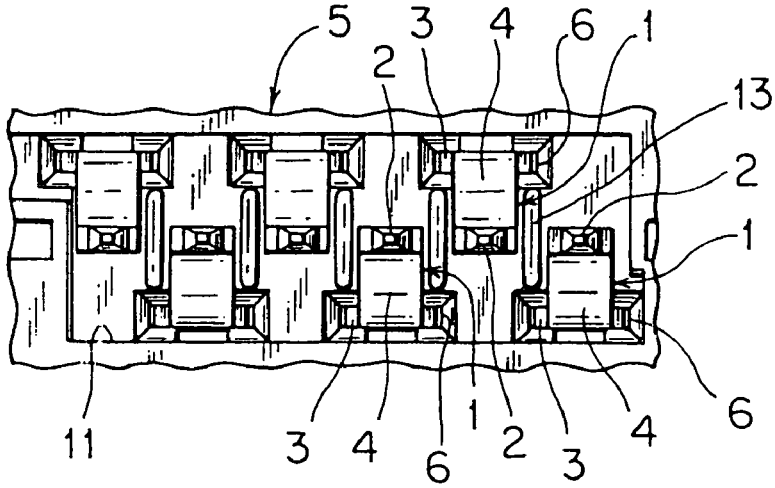
FIG. 2 is a plane view of the arrangement of press contact terminals shown in FIG. 1.
Figure 3:
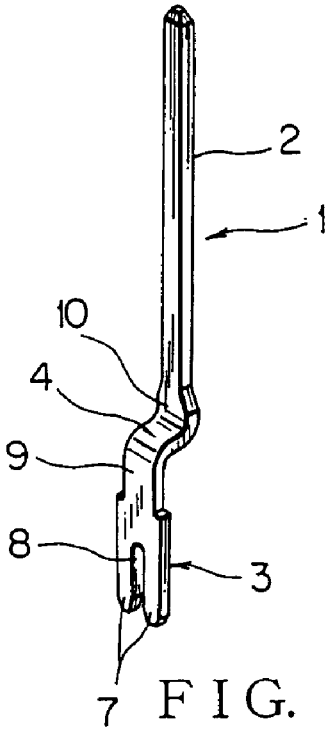
FIG. 3 is a perspective view of the press contact terminal of FIG. 1.

FIGS. 1 to 3 show a first embodiment of an arrangement of press contact terminals according to this invention.

As shown in FIG. 1, this arrangement of press contact terminals is characterized in that a plurality of electric contact parts 2 of press contact terminals 1 are arranged closely in a line perpendicular to bending directions of bent parts 4 of the press contact terminals 1, and said bent parts 4 continued to these electric contact parts 2 are arranged forward and backward alternately, thereby press contact parts 3 of the press contact terminals 1 are prevented from interfering with each other.

As shown in FIG. 2, electric contact parts 2 are arranged in a line perpendicular to electric wires (not shown) at even intervals. The bent parts 4 of the press contact terminals 1 are alternately arranged, for example, the bent part 4 at the right end in FIG. 2 is bent downward, the bent part 4 at the second from the right end is bent upward in a reverse direction of the bent parts 4 at the right end, and the bent parts 4 at the third from the right end is bent downward in a same direction of the bent parts 4 at the right end.

Figure 8:
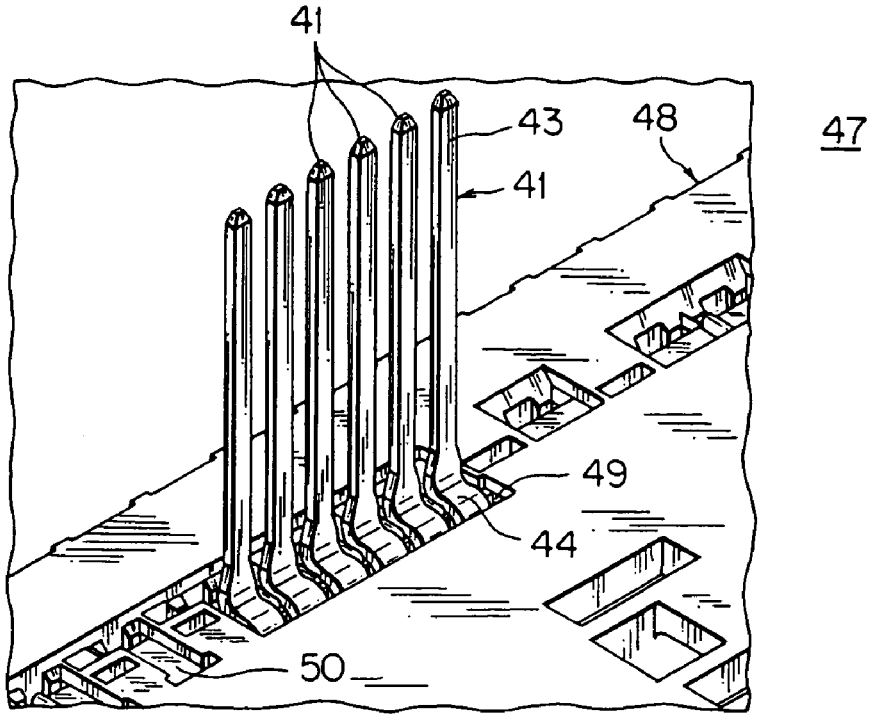
PRIOR ART FIG. 8
FIG. 8 is a perspective view showing a conventional arrangement of press contact terminals.
Figure 9:
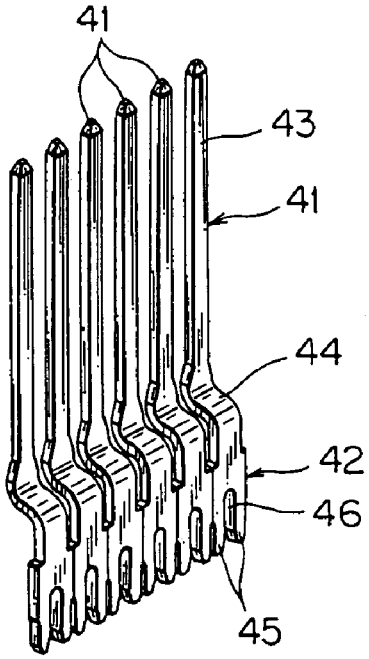
PRIOR ART FIG. 9
FIG. 9 is a perspective view showing the conventional arrangement of press contact terminals shown in FIG. 8.
Figure 10:
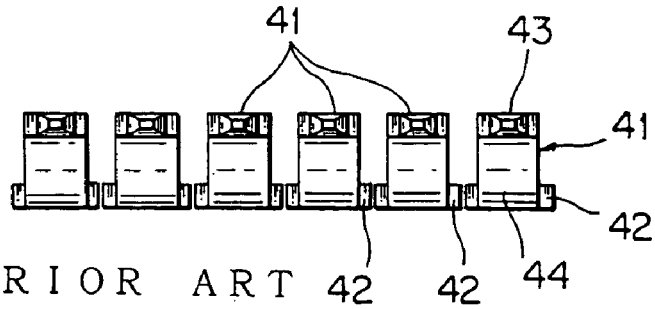
PRIOR ART FIG. 10
FIG. 10 is a plane view showing the conventional arrangement of press contact terminals shown in FIG. 8.

As shown in FIG. 3, the bent parts 4 is continued substantially perpendicular to the lower press contact part 3. The press contact parts 3 are inserted into or press-fitted into holes 6 formed alternately at front sides and back sides of a substrate 5 (circuit board) made of insulating synthetic resin shown in FIGS. 1 and 2. The press contact terminals 1 are substantially the same as the conventional press contact terminals shown in FIGS. 8, 9 and 10.

Namely, the press contact terminal 1 includes: a wide vertical press contact part 3 having a pair of press contact pieces 7 and a slot 8 formed between said contact pieces 7 for press-fitting an electric wire; a middle wide substrate 9 continued from the press contact part 3 in one plane; the bent part 4 in a step shape continued from the substrate 9, vertically and shortly bent, and having the same width as the substrate 9; a base 10 standing vertically, continued from the bent parts 4, and decreasing its width gradually; and the pin-shaped electric contact part 2 continued from the base 10 in one plane. The bent part 4 works as a step for supporting the press contact terminal 1. The press contact part 3 and the electric contact part 2 are formed in different planes, and parallel to each other. In this embodiment, a length of the bent part 4 is substantially the same as a width of the press contact part 3, and wider than a width of the electric contact part 2.

Since the holes 6 are alternately arranged on the insulated substrate (circuit board) 5, the press contact parts 3 are prevented from interfering with each other. Each press contact part 3 is press-contacted with the electric wire after being inserted into the hole 6 of the substrate 5. Since a method of press-contacting the electric wire is the same as the conventional method, a detailed explanation about said method will be omitted.

As shown in FIGS. 1 and 2, a shallow rectangular cavity 11 lower than a surface 30 of the substrate 5 is formed on the substrate 5. A surface of the cavity 11 works as a horizontal bearing surface 12 to bear the bent part 4 of the press contact terminal 1. The hole 6 having an elongated slit shape is continued from the bearing surface 12 perpendicular to the cavity 11 for inserting the press contact part 3.

As shown in FIG. 2, the hole 6 for inserting the press contact part 3 is wider than the width of the bent part 4 on the bearing surface 12. A combination of the hole 6 and the bearing surface 12, or the press contact part 3 and the bent part 4, is formed substantially a T-shape in a plane view. Low-profile insulating ribs 13 as partitions are projected from the surface of the cavity 11, and arranged between the press contact terminals 1. Said substantially T-shaped bearing surface 12 and the hole 6 is arranged around the pin-type electric contact parts 2 backward and forward alternately, in a longitudinal direction of the electric wires. Electric contact parts 2 are arranged in a line. The holes 6 arranged in each line perpendicular to the longitudinal direction of the electric wires are spaced in a little narrower width than the width of the bent part 4.

Similarly to the conventional arrangements, each of the electric contact parts 2 is received in a insulated connector housing (not shown), and connected to such as a female terminal or a joint terminal (not shown) in the connector housing. The connector includes the connector housing and press contact terminals.

The connector housing is fixed to the substrate 5 by means of thread fastening, engagement, or the like. For example, an electrical junction box may include the connector, the substrate 5, a plurality of electric wires (not shown), a bus-bar circuit board, a relay, a fuse, an electronic unit, and a cover. The electrical junction box includes at least a connector having the press contact terminals 1 and a connector housing, the substrate 5, and electric wires to be connected to the press contact terminals 1 respectively.

In addition, the pin-type electric contact parts 2 can be replaced with tab-type electric contact parts (not shown) having substantially the same width as those of the bent parts 4. Both pin-type and tab-type electric contact parts 2 are defined as male electric contact parts.

According to this embodiment, by alternately arranging the press contact terminals 1 as conventional press contact terminals, the wide press contact parts 3 can be prevented from interfering with each other at low cost.

Figure 4:
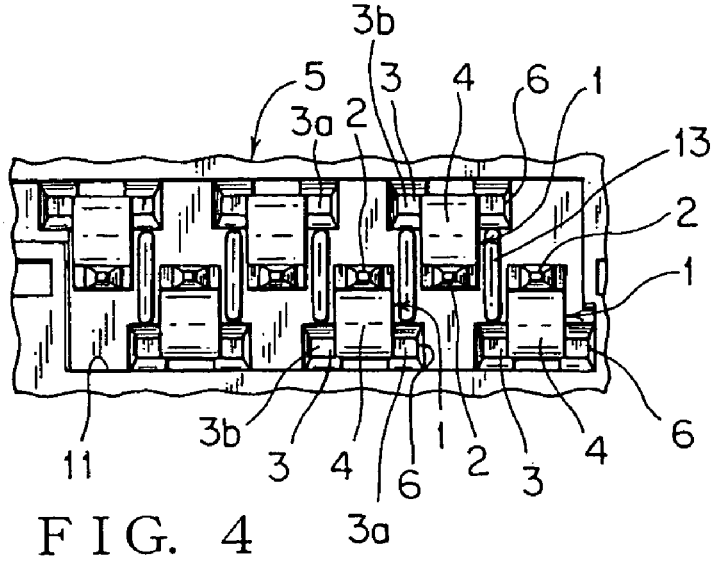
FIG. 4 is a plane view showing an arrangement by modifying the arrangement of the press contact terminals shown in FIGS. 1 and 2.

FIG. 4 shows one embodiment of a compact connector and a compact electrical junction box having press contact terminals 1. Said connector and electrical junction box are miniaturized by overlapping each press contact part 3 arranged in one line over the neighboring press contact part 3 arranged in the other line in their thickness direction.

Each of the press contact terminals 1 has the same size, shape, and arrangement as those in FIGS. 1 and 2, however, for convenience in explaining, the press contact parts 3 in FIG. 4 are shown wider than those in FIG. 2. By overlapping the press contact parts 3 arranged in two lines in their width direction, one side parts 3*a* of the press contact parts 3 arranged in a lower line and the other side parts 3*b* of the press contact parts 3 arranged in an upper line face to each other, and the other side parts 3*b* in the lower line and the one side parts 3*a* in the upper line face to each other.

Figure 5:
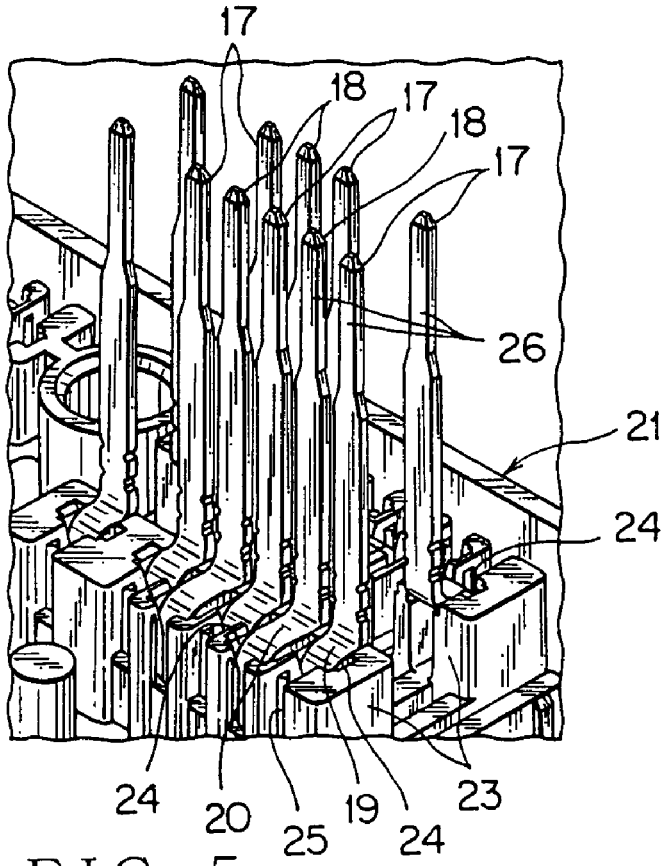
FIG. 5 is a perspective view showing a second embodiment of an arrangement of press contact terminals according to this invention.
Figure 6:
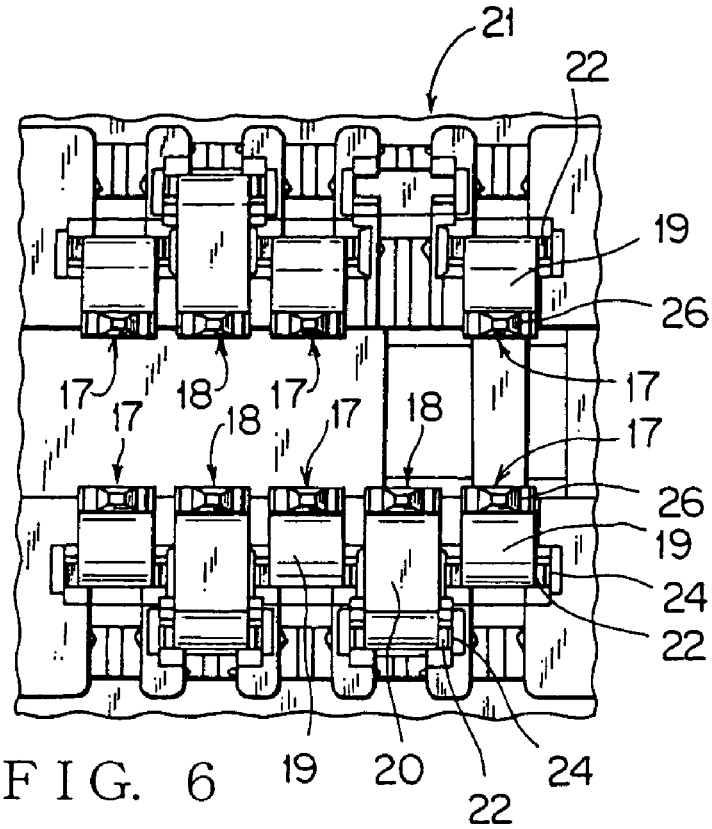
FIG. 6 is a plane view of the arrangement of the press contact terminals shown in FIG. 5.

FIGS. 5 and 6 show a second embodiment of the arrangement of press contact terminals according to this invention.

As shown in FIG. 5, this arrangement of press contact terminals is characterized in that there are two types of lengths of bent parts 19, 20, each bent part 19, 20 is bent in the same direction on a substrate (circuit board) 21, and a press contact terminal 17 having the shorter bent part 19 and a press contact terminal 18 having the longer bent part 20 are alternately arranged, namely, as shown in FIG. 6, offset lengths of two neighboring press contact parts 22 are different form each other, thereby press contact parts 22 are prevented from interfering with each other.

As shown in FIGS. 5 and 6, the press contact terminals 17, 18 are arranged in two lines. In each line, the press contact terminals having two types of offset lengths, namely, bending lengths are alternately arranged. The press contact terminals arranged in two lines are symmetrically arranged back to back.

The press contact terminal 17 at a right end in FIG. 6 has a shorter bent part 19, which is as short as the bent part 4 of the press contact terminal 1 in FIG. 3. The press contact terminal 18 at a second right end in FIG. 6 has a longer bent part 20, which is shorter than or equal to twice as long as the bent part 4 of the press contact terminal 1 in FIG. 3. The press contact terminal 17 at a third right end in FIG. 6 has a shorter bent part 19, which is the same as the bent part 19 of the press contact terminal at the right end. Thus, the press contact terminals 17, 18 having a shorter bent part. 19 and a longer bent part 20 respectively are alternately arranged.

As shown in FIG. 5, a substantially box shaped block 23 for arranging the press contact terminals 17, 18 in a line is integrally formed with the substrate (circuit board) 21 made of insulating resin. The block 23 has horizontally grooved bearing surfaces (not shown) for bearing the bent parts 19, 20 of the press contact terminals 17, 18 at an upper end of the block 23. The block 23 also has vertical holes 24 perpendicular to the bearing surfaces respectively for inserting or press-fitting the press contact terminals 22.

The bearing surfaces having respectively a shorter length and a longer length are alternately arranged corresponding to the lengths of the bent parts 19, 20. A pair of the bearing surface and the hole 24 makes a substantially T-shape in a plane view. Each hole 24 communicates with a vertical slit 25. The electric wire (not shown) can be press-contacted with the press contact part 22 in the slit 25. The electric wire normally extends in a thickness direction of the press contact terminals 17, 18, namely, a bent parting direction of the bent parts 19, 20.

Also in this embodiment, electric contact parts 26 are arranged in a line for adapting to arrangements of such as female terminals of a mating connector, or joint terminals of a connector housing.

In this embodiment, offsets of the press contact parts 22 allows the press contact terminals to be arranged in two lines back to back. These two lines of the press contact terminals 17, 18 can be received in one connector housing. Further, these lines can be received by two connector housings respectively. Further, these lines can be connected respectively to two mating connectors. The connector includes a plurality of press contact terminals 17, 18 and a connector housing.

Each of the electric contact parts 26 of the press contact terminals 17, 18 has a tab-type shape, which is the same width as the bent parts 19, 20 from its bottom to its middle part, and has a pin-type slim shape from its middle part to its upper end. Each electric contact part 26 is male-type. As shown by the insertion holes 24 in FIG. 5, the press contact parts are wider than bent parts 19, 20 and the electric contact parts 26. A base of the press contact part 22, which is a base part of the press contact terminal without press contact pieces, is fixed inside the hole 24. The bent parts 19, 20 are positioned stably on the bearing surfaces as the horizontal grooves.

The connector housing is fixed to the substrate 21 by means of thread fastening, engagement, or the like. For example, an electrical junction box may include the connector, the substrate 21, a plurality of electric wires (not shown), a bus-bar circuit board, a relay, a fuse, an electronic unit, and a cover. The electrical junction box includes at least a connector having the press contact terminals 17, 18 and a connector housing, the substrate 21, and electric wires to be connected to the press contact terminals 17, 18 respectively.

According to this invention, since the press contact parts 22 of the press contact terminals 17, 18 are arranged closely together in one direction, workability of press-contacting the electric wires can be improved. Further, workability of connecting connectors can be improved by arranging closely the two lines of electric contact parts 26 back to back.

Figure 7:
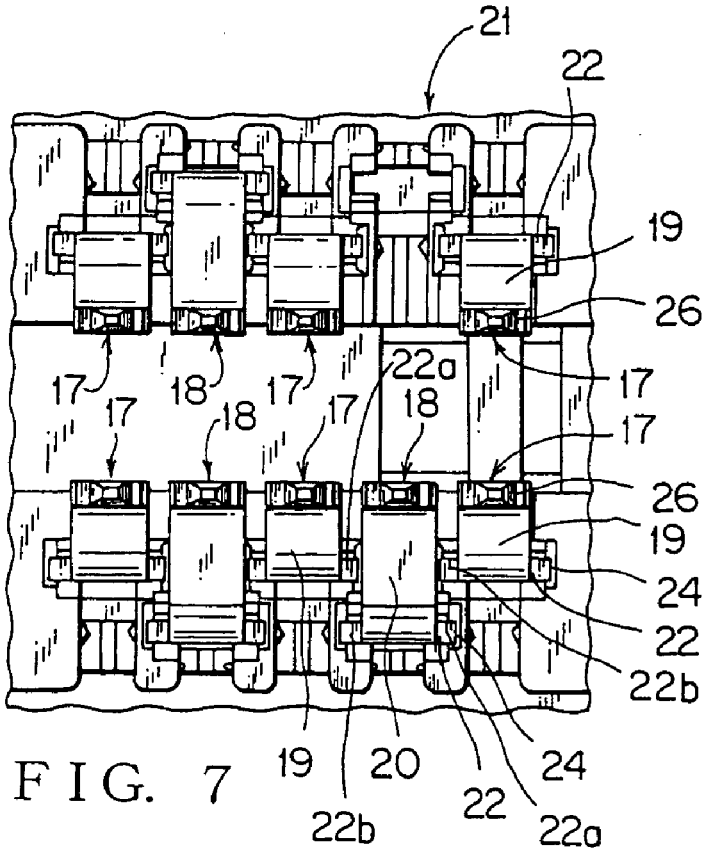
FIG. 7 is a plane view showing an arrangement by modifying the arrangement of the press contact terminals shown in FIGS. 5 and 6.

FIG. 7 shows one embodiment of a compact connector and a compact electrical junction box having press contact terminals 17, 18. Said connector and electrical junction box are miniaturized by overlapping each press contact part 22 arranged in one line over the neighboring press contact part 22 arranged in the other line in their thickness direction.

Each of the press contact terminals 17, 18 has the same size, shape, and arrangement as those in FIGS. 5 and 6, however, for convenience in explaining, the press contact parts 22 in FIG. 7 are shown wider than those in FIG. 6. By overlapping the press contact parts 22 arranged in two lines in their width direction, one side parts 22*a* of the press contact parts 22 arranged in a lower line and the other side parts 22*b* of the press contact parts 22 arranged in an upper line face to each other, and the other side parts 22*b* in the lower line and the one side parts 22*a* in the upper line face to each other.

What is claimed is:

1. An arrangement of press contact terminals, comprising press contact terminals, each of which has an electric contact part, a bent part, and a press contact part for being connected with an electric wire, whereby the electric contact parts are arranged in line, the bent parts are bent alternately forward and backward in a direction perpendicular to the line of arrangement of the electric contact parts for aranging the press contact parts alternately in different direction and wherein neighboring press contact parts of said press contact terminals arranged in one line overlap the press contact parts arranged in the other line, in a direction perpendicular to a line of arrangement of the press contact terminals.

2. The arrangement of press contact terminals as claimed in claim 1, wherein each of said press contact terminals has an identical shape.

3. A connector comprising the arrangement of the press contact terminals as claimed in claim 2.

4. An electrical junction box comprising said connector as claimed in claim 3.

5. A connector comprising the arrangement of the press contact terminals as claimed in claim 1.

6. An electrical junction box comprising said connector as claimed in claim 5.

7. An arrangement of press contact terminals, each of which has an electric contact part, a bent part, and a press contact part for press-contacting an electric wire, whereby at least two types of the press contact terminals having two different lengths in the bent parts are employed, the electric contact parts of the press contact terminals are arranged in line, the bent parts are bent in one direction and perpendicular to the line of arrangement of the electric contact parts, and the press contact terminals having longer bent parts and those having shorter bent parts are alternately arranged.

8. The arrangement of press contact terminals as claimed in claim 7, wherein neighboring press contact parts of said press contact terminals overlap each other in a direction perpendicular to a line of arrangement of the press contact terminals.

9. A connector comprising the arrangement of the press contact terminals as claimed in claim 7.

10. An electrical junction box comprising said connector as claimed in claim 9.

* * * * *